United States Patent [19]

Veysset et al.

[11] Patent Number: 4,686,067

[45] Date of Patent: Aug. 11, 1987

[54] PROCESS FOR ELIMINATING DEPOSITS FORMED IN A STEAM GENERATOR OF A PRESSURIZED WATER NUCLEAR REACTOR

[75] Inventors: Jean-Paul Veysset, Esbly; Jean-Jacques Camp; Didier Noel, both of Avon, all of France

[73] Assignee: Electricite de France Service National, Paris, France

[21] Appl. No.: 687,264

[22] Filed: Dec. 28, 1984

[30] Foreign Application Priority Data

Apr. 5, 1984 [FR] France ..... 84 05377

[51] Int. Cl.[4] ..... G21F 9/00; G21C 19/32

[52] U.S. Cl. ..... 252/626; 134/3; 134/22.1; 134/22.11; 134/22.14; 134/41; 252/82; 376/305; 376/310

[58] Field of Search ..... 252/626, 80, 142, 82, 252/86, 146, 87, 147; 376/306, 305, 310; 210/696; 122/379; 134/2, 3, 22.1, 22.11, 22.14, 27, 28, 41; 204/1.5; 60/646; 148/6.14, 132; 427/309, 327

[56] References Cited

U.S. PATENT DOCUMENTS

| | | | |
|---|---|---|---|
| 3,184,389 | 5/1965 | Kersten | 376/306 |
| 3,294,644 | 12/1966 | Walton | 376/306 |
| 3,973,998 | 8/1976 | Datta et al. | 427/327 |
| 4,250,048 | 2/1981 | Leveskis | 252/142 |
| 4,364,900 | 12/1982 | Burrill | 376/306 |
| 4,485,028 | 11/1984 | King | 252/99 |

FOREIGN PATENT DOCUMENTS

| | | |
|---|---|---|
| 689497 | 11/1966 | Belgium . |
| 2262099 | 9/1975 | France . |
| 1019446 | 2/1966 | United Kingdom . |
| 1116895 | 6/1968 | United Kingdom . |

OTHER PUBLICATIONS

Gonzalez-Velasco, 1978, Electromigration behaviour of complexes between Fe(III) and Cu(III) Ions and Gluconic Acid, Anales De Quimica, pp. 17-21.

Rentler, et al., 1983, PWR Model Steam Generator Corrosion Studies, Combustion Engineering Inc. Windsor, Ct., 6 pages, EPRINP-3138 Research Project 623-1.

EPRI NP-3275, vol. 1, 1984, Causes of Denting: Summary Report.

*Primary Examiner*—Stephen J. Lechert, Jr.
*Assistant Examiner*—Howard J. Locker

[57] ABSTRACT

Process for the elimination of corrosion products formed on the tube plate and in the gaps between the tubes and the spacer plates of a steam generator of a pressurized water nuclear reactor, in order to prevent the appearance of a corrosion phenomena, which can lead to necking or denting of tubes by oxide growth.

The process consists of reacting with said oxides at between 50° and 100° C., an aqueous solution containing 6 to 8% gluconic acid, 3 to 5% citric acid, approximately 0.5% of a corrosion inhibitor and ammonia until a pH between approximately 3 and 9.5 is obtained.

6 Claims, 5 Drawing Figures

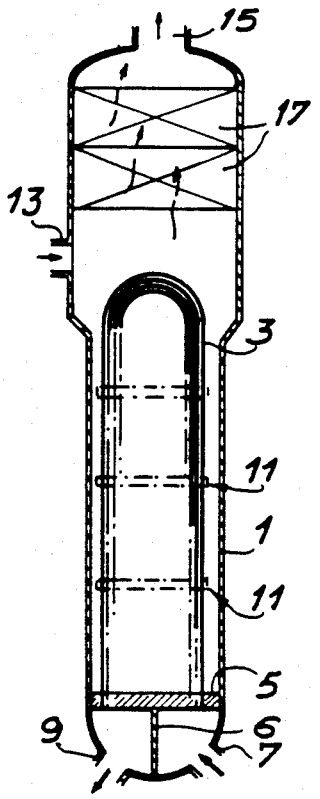
FIG.1
FIG.2A
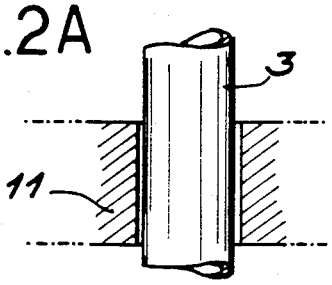
FIG.2B
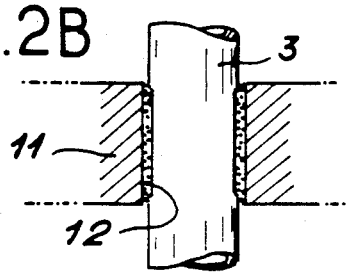
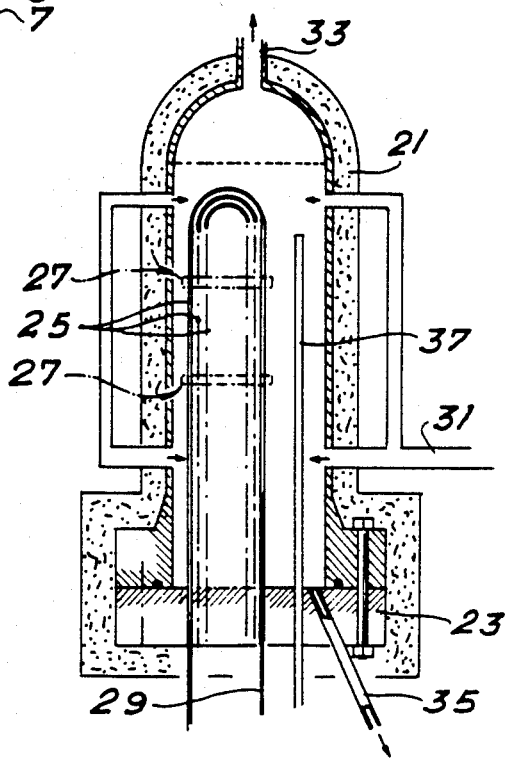
FIG.3

PROCESS FOR ELIMINATING DEPOSITS FORMED IN A STEAM GENERATOR OF A PRESSURIZED WATER NUCLEAR REACTOR

BACKGROUND OF THE INVENTION

The present invention relates to a process for eliminating deposits formed in a steam generator of a pressurized water nuclear reactor. It more specifically relates to a process for eliminating deposits formed on the tube plate and in the gaps between the tubes and the spacer plates of a pressurized water nuclear reactor steam generator.

It is known that in a steam generator of this type, the primary fluid from the reactor circulates in a bundle of tubes fixed by expansion and welding in a tube plate which is positioned above the water box of the steam generator. These tubes are held in place by means of perforated spacer plates. During the operation of the reactor, steam generators lead to damage due to the deposition of oxides and corrosive products accumulating on the tube plate and in the gaps between the tubes and the spacer plates. The deposits on the tube plates permit the accumulation and concentration of noxious products, such as chlorides, sulphates and hydroxide ions. These products lead to the corrosion of the tubes, either through forming cracks, pitting or intergranular attacks. The oxides in the gaps between the spacer plates and the tubes can also be to the formation of a medium which is highly corrosive to the steel of the plates. The oxides produced by this corrosion lead to a contraction of the diameter of the tube, and this can lead to the cracking thereof.

This phenomenon, which is generally known under the name of "denting" and which will be examined in detail hereinafter makes it necessary to plug or seal the affected tubes.

These deposits cannot be mechanically eliminated because it is not possible to obtain access thereto due to the geometry of the steam generators. However, it is possible to act chemically thereon and several processes are presently used for this purpose.

Among the known processes making it possible to act chemically thereon and dissolve the corrosive products of the secondary circuit reference can be made to that involving the use of an ethylene diamine tetraacetic acid solution (EDTA).

The stages of this process are referred to hereinafter and it is possible to repeat the same and optionally combine a number of rinsing operations.

(a) Dissolving corrosion products deposited on the tube plate

The solution contains:

EDTA: 10% by weight

Hydrazine: 1% by weight

Corrosion inhibitor: 0.5% by weight

The pH is adjusted to 7.0 with ammonia. The contact time is 7 h at a temperature of 93° C.

(b) Dissolving the copper contained in the deposited corrosion products

The solution contains:

EDTA: 5% by weight

Hydrogen peroxide: 2% by weight

The pH is adjusted to 7.0 with ammonia, and then to 10.0 using ethylene diamine. The contact time is 4 to 6 h at a temperature of 38° C.

(c) Dissolving of corrosion products present in the gaps between the tubes and the spacer plates The solution contains:

EDTA: 20% by weight

Corrosion inhibitor: 1% by weight

The pH is adjusted to 6.0 with ammonia. The contact time is approximately 120 h at a temperature of 121° C.

Such a process suffers from the disadvantage of requiring a number of washing operations leading to large effluent quantities. Moreover, after a certain operating time, corrosion by pitting occurs, particularly in the case of manganese - nickel - molybdenum - steel forming the ferrules.

The object of the present invention is to eliminate these disadvantages by providing a washing process using a solution making it possible to dissolve the corrosion products present in the secondary circuit of a steam generator, without leading to the damage referred to hereinbefore.

SUMMARY OF THE INVENTION

The present invention relates to a process for eliminating the oxides formed on the tube plate and in the gaps between the tubes and the spacer plates of steam generator of a pressurized water nuclear reactor, in order to eliminate the risk of tube corrosion (pitting, stress corrosion, intergranular corrosion) and prevent the appearance of a corrosion phenomenon which can lead to necking of the tubes as a result of oxide growth. The process comprises reacting with said oxides at between 50° and 100° C., an aqueous solution containing 6 to 8% of gluconic acid, 3 to 5% of citric acid and approximately 0.5% of a corrosion inhibitor and ammonia until a pH between approximately 3 and 9.5 is obtained.

BRIEF DESCRIPTION OF THE DRAWINGS

The invention is described in greater detail hereinafter relative to non-limitative embodiments and the attacked drawings, wherein show:

FIG. 1 a diagrammatic representation of steam generators, which are generally fitted to the primary circuit of a pressurized water nuclear reactor.

FIGS. 2A in vertical sectional form the passage and 2B of a tube in a spacer plate, respectively before operation and at the end of a certain operating time, in order to illustrate the denting phenomenon.

FIG. 3 a steam generator mock-up used in the study of corrosion.

DETAILED DESCRIPTION OF THE PREFERRED EMBODIMENTS

Figure 4:
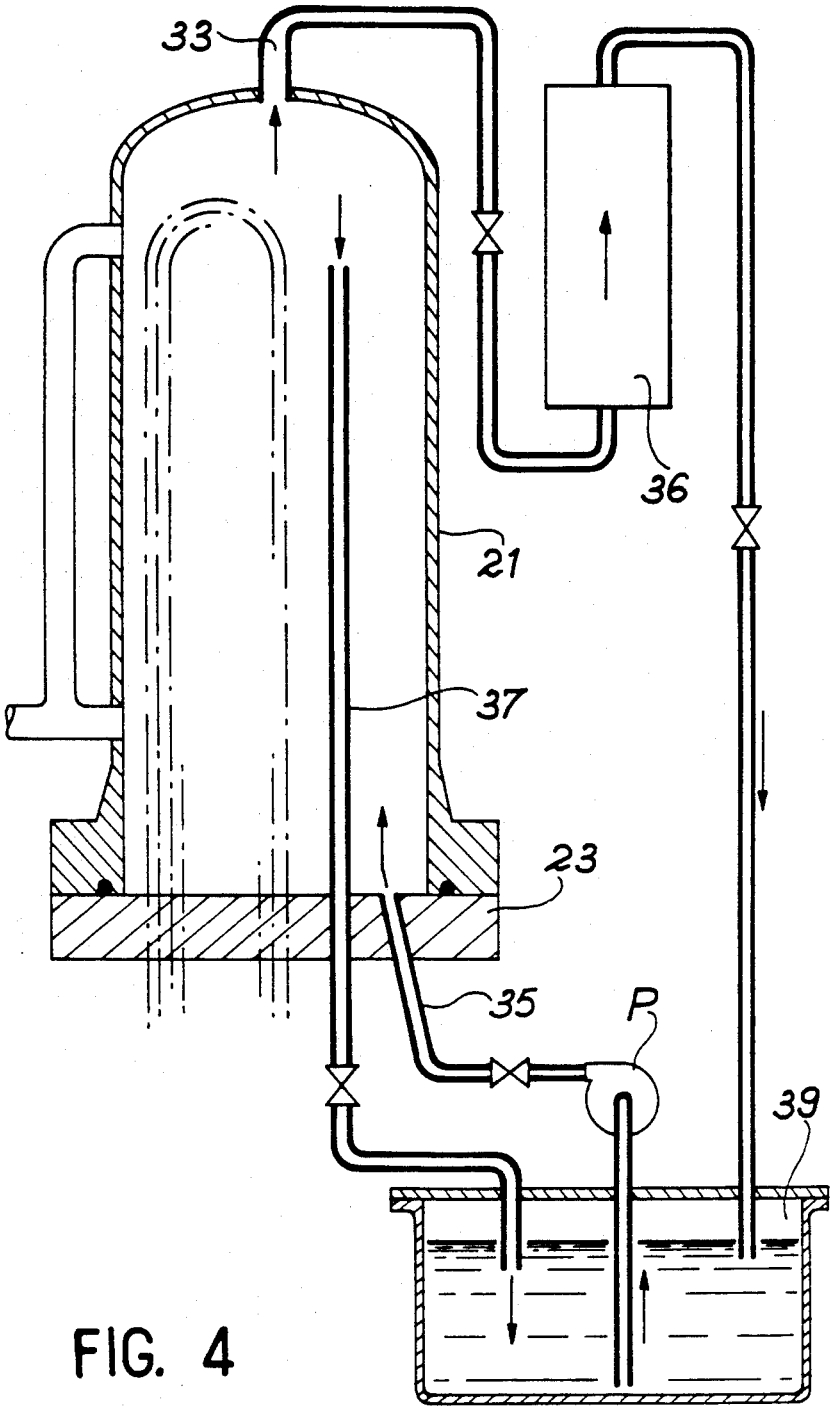
FIG. 4 an improved version of the apparatus of FIG. 3.

The steam generator shown in FIG. 1 comprises a vertical cylindrical enclosure, which contains a bundle of U-tubes 3 and a tube plate 5, to which are fixed tubes 3 and which defines with a vertical partition 6 in the lower part of the steam generator on the one hand a chamber for the distribution into tubes 3 of the primary fluid introduced by pipe 7 and on the other hand a chamber for collecting the primary fluid from tubes 3, said fluid then being discharged from the steam generator by pipe 9. Above plate 5, the tube bundle 3 is held in place by spacer plates 11, provided with different types of opening, the first type serving for the fitting of tubes 3 and the second for the passage of the secondary fluid between tubes 3. The secondary fluid which is introduced into the steam generator by pipe 13 is converted into steam by the heat from the primary fluid circulating in tubes 3, the steam being discharged by pipe 15 after passing through water - steam separators 17.

FIG. 2A shows a tube 3 in a spacer plate 11 prior to the operation of the steam generator. It can be seen that the tube 3, which is conventionally made from Inconel 600 passes through the spacer plate 11, which is normally made from carbon steel, with a clearance of a few tenths of a millimetre. The spacer plate defines within the steam generator small annular spaces in which, during the operation of the steam generator, there is an accelerated corrosion of the carbon steel. FIG. 2B shows the same tube 3, in a spacer plate 11, following several months of operation of the steam generator. In this case, it can be seen that the annular space has been filled with corrosion products 12, which develop during the operation of the power station. The expansion of these corrosion products 12 finally leads to stressing of the tubes 3 and the deformation thereof, which gives rise to a locak necking of tubes 3, said phenomenon generally being called denting.

Moreover, the growth of these corrosion products in the gaps between plate 11 and tubes 3 produces tensions and stresses, which also lead to deformations of the spacer plates 11, which causes stresses and distortions on certain of the tubes 3 of the bundle.

The process according to the invention making it possible to obviate denting phenomena is realized through making use of the action of a complexing acid medium constituted by gluconic acid used with a concentration of at least 0.1M whose complexing power, particularly in an alkaline medium, is very high with respect to the ferric ions which it complexes, as from a minimum pH of 3.0.

As gluconic acid does not dissolve iron oxides, an acid making it possible to achieve this result, namely citric acid, is added thereto.

The presence of this acid necessitates the addition of ammonia in order to obtain a pH above 3.0 compatible with the formation of gluconate - iron complexes. Moreover, to prevent the corrosion of non-stainless steels, as inhibitor is added.

In a non-restrictive manner with respect to the proportions of the constituents, excellent results were obtained with the following solution:

Gluconic acid: 7.5% by weight
Citric acid: 4% by weight
Ammonia: ad pH=3.1
Corrosion inhibitor: 0.4% by weight Apart from ferric ions, the gluconic acid also complexes cupric ions, so that the same solution can be used for dissolving cuprous corrosion products without any intermediate draining operations. This makes it possible to obviate the formation of excessive effluent quantities. For this purpose, the pH must be adjusted to 9.2 by the addition of ammonia and the potential of the solution can be adjusted to approximately 200 mV/SEC (saturated calomel electrode) by the addition of hydrogen peroxide or by bubbling compressed air in such a way as to oxidize the $CU^{O}$ and $CU^{I}$ into $CU^{II}$. The corrosion inhibitor is constituted by a mixture of amines having a sulphur content of approximately 5% by weight. Under these alkaline pH conditions, the corrosion inhibitor must remain soluble and for this reason the products sold under the trade name $P_6$ manufactured by Somafer is used.

During the dissolving of the iron oxides, the treatment temperature must be kept between 80° and 95° C., whilst during the dissolving of the copper oxides the temperature must be close to 50° C.

In order to verify the effectiveness of the process, tests were carried out in equipment like those shown in FIGS. 3 and 4, which are able to simulate the conditions of use of a steam generator of the type presently employed in pressurized water reactors.

FIG. 3 shows a steam generator comprising a thermally insulated enclosure 21 having an internal diameter of approximately 400 mm and a capacity of approximately 100 liters. At the bottom of said enclosure 21 is provided an approximately 200 mm thick tube plate 23, which is made from manganese - nickel - molybdenum steel. In said plate 23 are expanded and welded 15 tubes 25 representing the bundle of tubes in which circulates the primary fluid of the steam generator. Tubes 25 are bent in U-shaped manner with a radius of 55.6 mm, which corresponds to the smallest radius used in steam generators equipping ordinary water nuclear power stations of the Fessenheim type, and they are held in place by spacer plates 27 arranged along the bundle of tubes along tube plate 23, the height of said tubes above said plate 23 being approximately 1 meter. Thermoelectric elements 29 are disposed within the U-shaped tubes 25, at only one of the ends thereof, so as to dissipate a heat flow through the wall of the tubes in order to simulate the heating of the steam generator by a primary fluid. These thermoelectric elements 29 have a height of approximately 150 mm and they are positioned immediately above tube plate 23. A helium pressure is maintained within tubes 25.

At the bottom of enclosure 21, there is a pipe 31 for reintroducing thereinto the condensed steam discharged at the top of the enclosure by the discharge pipe 33. The enclosure also has a draining pipe 35 and a pipe 37 into which can be introduced, as required, a top-up heating element or for the return circulation of the solution according to the invention towards a reservoir.

In an installation of this type, a corrosion identical to that occurring in a pressurized water nuclear reactor steam generator is artificially produced by making the installation function in the following way. Pipe 31 introduces into enclosure 21 demineralized, degassed water by nitrogen bubbling, the installation having a pressurized injection pump (not shown in the drawing) for establishing a pressure of 47 bars in the enclosure and for maintaining the water level substantially constant above the bundle of tubes 25. Within tubes 25, the heat quantity produced by the thermoelectric elements 29 is regulated in such a way that the temperature of the water in the enclosure is maintained at 260° C. and the heat flow through the tubes 25 is 20 to 40 W / $cm^2$. The steam produced is discharged by pipe 33 and recycled after condensation in feed pipe 31.

The steam generator was operated for 1030 hours under the temperature and pressure conditions of a pressurized water reactor steam generator, but in the presence of a secondary medium polluted by sea water, with a conductivity between 120 and 240 $\mu S.cm^{-1}$ and mud taken from the tube plate of an industrial steam generator at the time of a shutdown for reloading, said phase being intended to produce a fouling state comparable to that of a steam generator which has already been in operation.

A certain number of corrosion testpieces made from various materials such as steels A42, A533, Z10C13, Inconel 600, etc. in good condition or having undergone several heat treatments were placed in the steam generator enclosure or in the sample box 36, which can be seen in FIG. 4. It is also possible to see in the latter that the liquid of reservoir 39 into which is introduced a solution according to the invention is sucked by a pump P and supplied by a pipe 35 to the steam generator. This liquid then enters pipe 33 and passes through sample box 36, or pipe 37 so as to return in both cases to reservoir 39.

An example of the use of this device will now be given.

Into the reservoir 39 containing approximately 215 liters of water were successively added the following products:

0.82 litres of corrosion inhibitor
10.4 kg of citric acid,
39 liters of a commercial 50% gluconic acid solution,
5.2 liters of 20% ammonia (d=0.920),
0.2 liters of corrosion inhibitor.

After homogenization, the pH of the solution was 3.2. The solution was heated to a temperature of 80°±2° C. and maintained at this temperature through the use of thermoelectric elements. The washing solution was then circulated in the apparatus by actuating pump P. Without the treatment, which lasted 170 hours, the ratio of the flows in the steam generator mock-up and in the sample box 36 was kept constant in such a way that the linear velocities of the fluid are identical throughout the circuit.

The following quantities were continuously measured: pH, potential/SEC, iron content and temperature of the solution, as well as the corrosiveness of the solution relative to the manganese - nickel - molybdenum steel, which was electrochemically measured in situ by means of the so-called Corrater probe.

Addition of the following was provided, according to the particular case:

1 kg of citric acid in the case when the pH rose above 4.0, in order to avoid a reduction of the effectiveness of the cleaning solution;

0.4 liter of corrosion inhibitor for the case where the Corrater probe reading suddenly changed towards higher values indicating an increase in the corrosiveness of the solution.

In actual fact, there was no need to add any reagent during the treatment. After 170 hours of treatment, the steam generator mockup was opened and the following was discovered:

the 1800 grammes of corrosion product deposited on the tube plate had almost completely disappeared;

the satisfactory appearance of the walls of the tubes and the mock-up;

the unblocking of 90% of the gaps between the tubes and the spacer plates;

the absence of corrosion by pitting of the tubes and Inconel 600 samples no matter what the thermal treatment rate of said alloy;

a slight corrosion by pitting of the manganese - nickel - molybdenum steel;

a slight generalized corrosion of non-stainless steel, less than 0.2 $\mu m.h^{-1}$.

What is claimed is:

1. A process for the elimination of corrosion products formed on the tube plate and in the gaps between tubes and spacer plates of a steam generator of a pressurized water nuclear reactor, in order to avoid the appearance of a corrosion phenomenon which can lead to necking or denting of tubes through oxide growth, comprising reacting with said oxides at a temperature between 50° and 100° C., an aqueous washing solution containing 6 to 8% gluconic acid, 3 to 5% citric acid, approximately 0.5% corrosion inhibitor and ammonia until a pH between approximately 3 and 9.5 is obtained and the potential of the solution is regulated to approximately 200 m V/SEC.

2. A process according to claim 1, wherein said corrosion inhibitor is soluble in said aqueous washing solution and comprises a mixture of several amines.

3. A process according to either claim 1 or claim 2, wherein said washing solution contains 7.5% by weight of gluconic acid 4% by weight of citric acid, 0.4% by weight of corrosion inhibitor and ammonia in a quantity sufficient to establish a pH of 3.1.

4. A process according to claim 1, wherein in order to eliminate any existant cupric ions, the reaction temperature is kept at about 50° C.

5. A process according to claim 1, wherein the potential is regulated by adding hydrogen peroxide to or by bubbling air through the solution.

6. A process according to claim 1, wherein the temperature of said aqueous washing solution is kept at betwen 80° and 95° C. to dissolve said oxides, in particular iron oxide but other than those of copper.

* * * * *